United States Patent [19]

Thiele et al.

[11] 4,069,830

[45] Jan. 24, 1978

[54] APPARATUS FOR CONDITIONING TOBACCO

[75] Inventors: Willi Thiele, Geesthacht; Gerd-Joachim Wendt; Werner Heyden, both of Hamburg, all of Germany

[73] Assignee: Hauni-Werke Korber & Co. KG, Hamburg, Germany

[21] Appl. No.: 693,371

[22] Filed: June 7, 1976

Related U.S. Application Data

[62] Division of Ser. No. 491,867, July 25, 1974, Pat. No. 3,978,868.

[51] Int. Cl.[2] ..... A24B 3/04

[52] U.S. Cl. ..... 131/135; 131/140 R

[58] Field of Search ..... 131/133–137, 131/140 R, 140 B, 34, 131

[56] References Cited

U.S. PATENT DOCUMENTS

| | | | |
|---|---|---|---|
| 2,311,824 | 2/1943 | Gautreau | 34/131 |
| 3,760,816 | 9/1973 | Wochnowski | 131/140 R |

*Primary Examiner*—Robert W. Michell

*Assistant Examiner*—Vincent Millin

*Attorney, Agent, or Firm*—Peter K. Kontler; John Kurucz

[57] ABSTRACT

A stream of moist tobacco is fed into one end of a rotating drum which is heated by steam circulating coils and wherein a current of heated air flows counter to the direction of tobacco travel. A portion of moisture-laden air issuing at the one end of the drum is evacuated into the atmosphere and the remaining portion of moisture-laden air is intercepted and recirculated into the other end of the drum by way of a duct which contains an adjustable device for mixing the recirculated portion of moisture-laden air with fresh air. The mixture is heated upstream of the other end of the drum, and the moisture content of dried tobacco is measured and compared with a desired moisture content. When the measured moisture content deviates from the desired moisture content, the rate of evacuation of moisture-laden air is changed simultaneously with the rate of admission of fresh air. Long-range deviations of measured moisture content from desired moisture content are compensated for by changing the intensity of heating action upon the drum so that the ratio of admitted fresh air to intercepted moisture-laden air normally remains constant.

9 Claims, 1 Drawing Figure

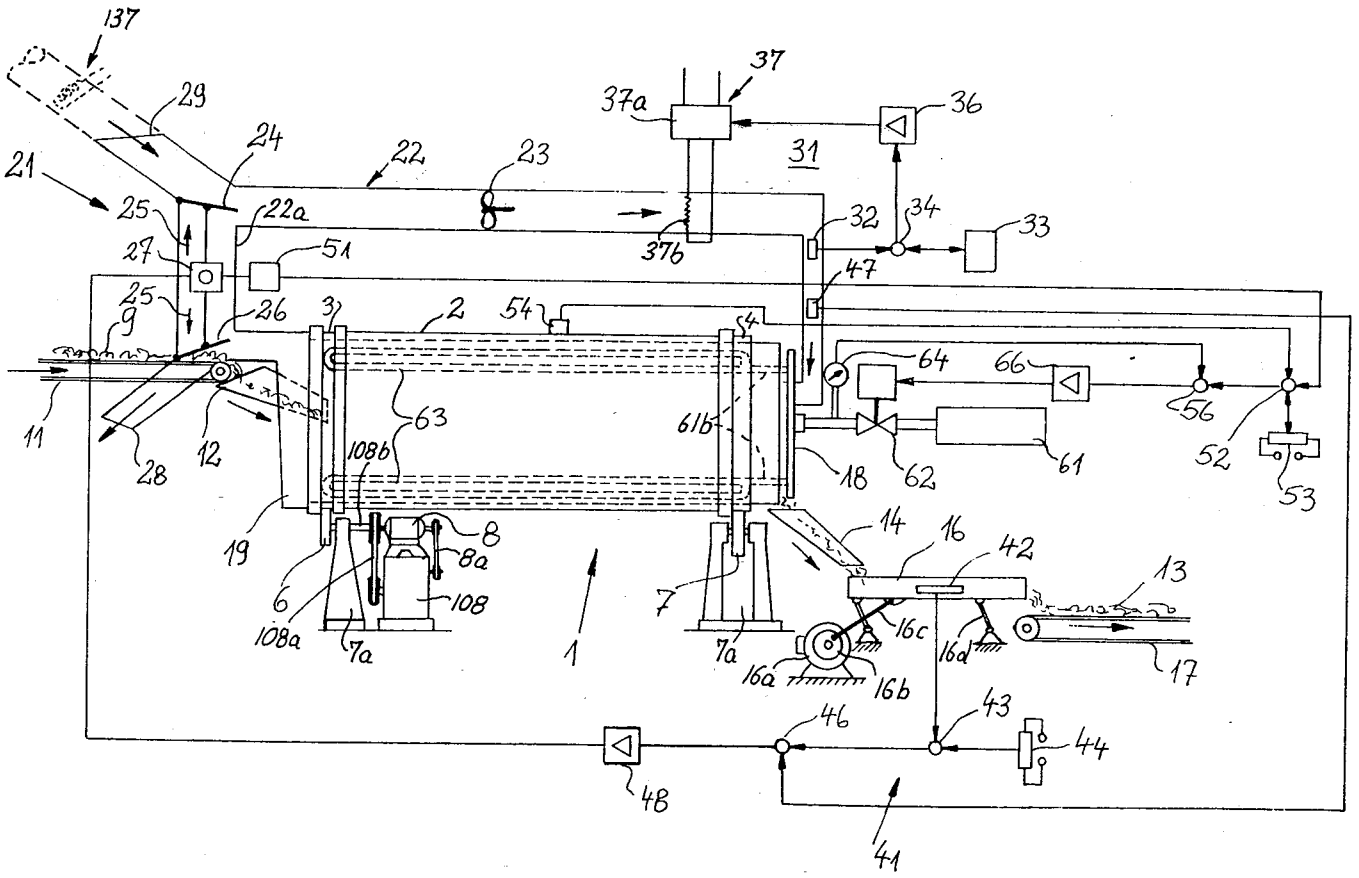
53
52
56
13
17
61
66
44
33
42
43
36
34
64
62
16
16a
16c
16b
14
41
32
47
18
31
46
37
4
61b
7a
37a
37b
7
48
1
23
54
8
8a
108
2
63
22
108b
7a
51
3
6
108a
24
22a
26
19
12
29
27
25
28
137
9
21
11

APPARATUS FOR CONDITIONING TOBACCO

CROSS-REFERENCE TO RELATED APPLICATION

This is a division of our copending application Ser. No. 491,867 filed July 25, 1974, now U.S. Pat. No. 3,978,868.

BACKGROUND OF THE INVENTION

The present invention relates to apparatus for conditioning tobacco, and more particularly to improvements in apparatus for controlled reduction of moisture content of tobacco particles in the form of whole leaves, ribs, stem, laminae and/or shreds.

It is already known to condition moist tobacco particles in a zone which is defined by a heated conveyor and wherein a current of heated gaseous fluid is caused to flow counter to the direction of tobacco transport. For example, the conveyor may include a rotary drum which surrounds the conditioning zone and is heated by one or more steam-circulating coils which rotate therewith to agitate the particles of tobacco in the conditioning zone. The gaseous fluid is normally air which is conveyed by a fan or the like and is heated before it enters the downstream end of the conditioning zone.

It is further known to recirculate a portion of moisture-laden fluid which issues from the downstream end of the conditioning zone and to mix such intercepted portion of moisture-laden fluid with a fresh fluid. As a rule, the percentage of moisture-laden fluid which is recirculated through the conditioning zone is rather low, i.e., the major part of such fluid is allowed to escape into the atmosphere. This is undesirable for several reasons, e.g., because the moisture-laden fluid has a pungent odor and also because substantial amounts of heat are dissipated into the atmosphere.

SUMMARY OF THE INVENTION

An object of the invention is to provide a novel and improved apparatus for reducing the moisture content of tobacco particles in a continuous operation, in a small area, with relatively low heat losses, and with a substantial reduction in that percentage of moisture-laden fluid which is allowed to escape into the atmosphere.

Another object of the invention is to provide a novel and improved apparatus having a conditioning zone wherein a current of gaseous fluid is caused to flow counter to the direction of tobacco travel.

A further object of the invention is to provide an apparatus wherein the percentage of pungent fluid which is permitted to escape into the atmosphere is normally constant and is caused to increase or decrease for a short interval of time only when the final moisture content of conditioned tobacco deviates from a desired moisture content.

An additional object of the invention is to provide a novel and improved apparatus for conditioning a gaseous fluid which is brought into contact with tobacco particles while flowing in one direction and while the particles of tobacco are being transported in the opposite direction.

A further object of the invention is to provide the apparatus with novel and improved means for conditioning the fluid which contacts the particles of tobacco while flowing counter to the direction of tobacco travel through an elongated conditioning zone.

Another object of the invention is to provide the apparatus with novel and improved means for controlling the rate of evacuation of spent moisture-laden gaseous fluid into the atmosphere and for controlling the characteristics, particularly the quantity, moisture content and/or temperature of fluid which is about to enter the conditioning zone.

A further object of the invention is to provide the apparatus with novel and improved means for compensating for short-lasting and long-lasting deviations of moisture content of conditioned tobacco from a desired moisture content.

The invention resides in the provision of an apparatus for reducing the moisture content of a stream of tobacco particles which are transported by a conveyor in a predetermined direction through an elongated conditioning zone into which particles of moist tobacco enter at one end and from which particles of dried tobacco are discharged at the other end. The apparatus comprises means for heating the conveyor, means for passing through the conditioning zone a current of a heated gaseous fluid counter to the predetermined direction so that the particles are heated by the conveyor as well as by the fluid and release moisture which is entrained by the fluid (i.e., the fluid leaving the conditioning zone is laden with moisture), means for intercepting a portion of moisture-laden fluid at the one end of the conditioning zone and for conveying the intercepted portion of fluid along a predetermined path (e.g., in a suitable duct) into the other end of the conditioning zone, means for mixing the moisture-laden fluid in the predetermined path with a drier fluid (e.g., with atmospheric air which may but need not be preheated), means for measuring the moisture content of dried tobacco particles, means for comparing the measured moisture content with a predetermined or desired moisture content, and means for changing the ratio of moisture-laden fluid to dried fluid in the predetermined path as a function of the extent of deviation of measured moisture content from desired moisture content.

The fluid is preferably air, and the heating means may include means for effecting an exchange of heat between the conveyor and at least one current of circulating steam. The conveyor may include a hollow drum-shaped member which surrounds the conditioning zone, and the apparatus may further comprise means for rotating the drum-shaped member.

The apparatus preferably further comprises means for increasing the ratio of drier fluid simultaneously with a reduction of the ratio of moisture-laden fluid in the predetermined path, or vice versa, so that the quantity of fluid entering the conditioning zone at the other end of such zone is substantially constant.

The apparatus preferably also comprises means for maintaining the temperature of the mixture of moisture-laden and dried fluid in the predetermined path at a substantially constant value; such means may include a temperature measuring device which is located immediately upstream of the locus where the current enters the other end of the conditioning zone. Signals which are furnished by the measuring device are used to requiste the temperature of fluid which is about to enter the drum-shaped member.

The heating means may comprise means for subjecting the conveyor to a heating action of variable intensity, and it is further preferred that the ratio of moisture-laden fluid to drier fluid in the predetermined path should equal or approximate a predetermined value.

The apparatus then preferably further comprises means for changing the intensity of heating action in response to a change in the ratio so that heating of tobacco particles by the conveyor is respectively intensified and diminished when the ratio of moisture-laden fluid to drier fluid respectively decreases and increases whereby the deviation of measured moisture content from desired moisture content decreases and ultimately disappears, and the ratio again approximates or equals the predetermined value.

The novel features which are considered as characteristic of the invention are set forth in particular in the appended claims. The improved conditioning apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE is a partly diagrammatic elevational view of a tobacco conditioning apparatus which embodies the invention.

DESCRIPTION OF THE PREFERRED EMBODIMENTS

The conditioning apparatus which is shown in the drawing comprises a conveyor 1 including a slightly inclined hollow drum-shaped member 2 and means for rotating it about a substantially horizontal axis. The rotating means comprises an electric motor 8 or another suitable prime mover which drives the input member of a variable-speed transmission 108 through the medium of a first belt or chain drive 8*a*. The output member of the transmission 108 drives a shaft 108*b* through the medium of a second belt or chain drive 108*a*, and the shaft 108*b* carries a pinion 6 in mesh with a ring gear 3 on the drum 2. The latter is rotatably supported by two groups of idler rolls 7 (only the right-hand group shown) which are mounted in upright columns 7*a*. The rolls 7 engage cylindrical peripheral surfaces 4 of the drum 2. The just described means for rotating the drum 2 is known in the art of tobacco conditioning apparatus.

A continuous stream of moist tobacco particles 9 is fed into the left-hand end of the drum 2 by a belt conveyor 11 and a fixedly mounted downwardly inclined chute 12. The right-hand end of the drum 2 discharges conditioned tobacco particles 13 into a second downwardly inclined chute 14 which in turn discharges conditioned tobacco particles into the trough 16 of a vibratory conveyor further including a motor 16*a*, a disk 16*b* on the output shaft of the motor 16*a*, and a connecting rod 16*c* which is eccentrically mounted on the disk 16*b* and is articulately connected to the trough 16. The latter is supported by leaf springs 16*d*. The right-hand end of the trough 16 discharges conditioned tobacco particles 13 onto the upper stretch of an endless take-off conveyor 17 which delivers such particles to a further processing station, e.g., into the magazine of a cigarette rod making machine if the stream on the belt conveyor 11 consists of shredded tobacco.

The stream of moist tobacco particles 9 which pass through the rotating drum 2 is conditioned (heated, agitated and therefore dried) by exchanging heat with the drum 2 and with means for heating the drum as well as with a current of a gaseous conditioning fluid (preferably air) which flows countercurrent to the tobacco stream, i.e., the current of conditioning fluid enters the right-hand end and leaves through the left-hand end of the elongated conditioning zone in the drum 2. The inlet for admission of the fluid is shown at 18 and the outlet for controlled evacuation of fluid is shown at 19. A portion of the current of conditioning fluid is recirculated from the outlet 19 to the inlet 18 along a predetermined path defined by a pipe or duct 22 which contains a motor-driven fan 23 or other suitable means for moving the fluid and an element 37*b* of an adjustable heating unit 37 which heats the fluid in the duct 22 downstream of the fan 23. That portion (22*a*) of the duct 22 which is directly connected with the outlet 19 contains a mixing unit 21 which serves to permit a portion of moisture-laden fluid leaving the drum 2 via outlet 19 to escape into the atmosphere (by way of a discharge opening 28) and to enable the fan 23 to draw drier fresh fluid (atmospheric air) into the main portion of the pipe 22 by way of an intake opening 29. The mixing unit 21 comprises two valve members 24, 26 here shown as pivotable flaps which respectively regulate the rate of admission of fresh fluid via opening 29 and the rate of evacuation of moisture-laden fluid via opening 28. The flaps 24, 26 are mechanically connected with an adjustable servomotor 27 which can move the flaps simultaneously in directions indicated by arrows 25 or counter to such directions. The parts 24, 26, 27 together constitute an adjustable controlling means which determines the rate of evacuation of moisture-laden fluid via opening 28 and the rate of admission of fresh fluid via opening 29. When the servomotor 27 is actuated to simultaneously move the flaps 24, 26 in the directions indicated by arrows 25, the rate of evacuation of moisture-laden fluid via opening 28 decreases simultaneously with a decrease in the rate of admission of fresh fluid via opening 29, i.e., the conditioning apparatus then circulates a larger quantity of hot moisture-laden fluid from the outlet 19 back to the inlet 18. The mounting of the flaps 24, 26 is preferably such that the rate of fluid flow in the main portion of the duct 22 toward the inlet 18 is constant or nearly constant, i.e., the quantity of moisture-laden fluid which escapes via opening 28 per unit of time is preferably identical with the quantity of fresh fluid which is admitted via opening 29. When the servomotor 27 receives a signal to move the flaps 24, 26 counter to the directions indicated by arrows 25, the rate at which the outflow of moisture-laden fluid via opening 28 increases is identical or nearly identical with the rate at which the inflow of fresh fluid via opening 29 increases. The temperature and moisture content of fluid which is discharged into the atmosphere by way of the opening 28 are normally much higher than the temperature and moisture content of atmospheric air which is admitted by way of the opening 29. If desired or necessary, fresh air which enters the duct 22 by way of the opening 29 can be preheated by an auxiliary heating unit 137 (shown by broken lines because it is optional) to thus relieve the main or primary fluid heating unit 37 so that the latter can more rapidly change the temperature of fluid flowing toward the inlet 18 if such temperature deviates from an optimum temperature which is necessary to insure that the moisture content of tobacco particles leaving the drum 2 is within a predetermined (and normally extremely narrow) range. For example, it is not unusual to maintain the temperature of conditioned tobacco particles within a range which deviates by a small fraction of one percent from a predetermined temperature.

The heating unit 37 forms part of a temperature regulating unit 31 further including a detector 32 which is mounted in the duct 22 downstream of the heating unit 37 and monitors the temperature of fluid which is about to enter the discharge end of the drum 2. The detector 32 furnishes electric signals to a signal comparing junction 34 which further receives a reference signal of predetermined intensity from a preferably adjustable rated value setting device 33 (e.g., a potentiometer) and transmits signals to an amplifier 36 when the temperature which is determined by the detector 32 deviates from an optimum temperature represented by the signal from the potentiometer 33. The signal from the amplifier 36 is transmitted to a register **37*a* which regulates the flow of current to the element 37*b* (e.g., an electric resistance heater) of the heating unit 37. The element 37*b* is installed in the pipe 22 downstream of the fan 23. The detector 32** is preferably a heat-sensitive semiconductor of the PTC or NTC type.

The means for adjusting the servomotor 27 (i.e., for controlling the rate of evacuation of moisture-laden fluid via opening 28 and the rate of admission of fresh fluid via opening 29) comprises a second regulating unit 41 which includes a moisture detector 42 mounted in the trough 16 and constituting a transducer which transmits electric signals to a junction 43. The latter further receives signals from a rated value selector 44 (preferably an adjustable potentiometer) which is set to furnish a reference signal representing the desired or normal rate of evacuation of moisture-laden fluid. The junction 43 transmits signals to a second junction 46 which can transmit signals to the servomotor 27 by way of an amplifier 48. The junction 46 further receives signals from a second detector 47 which is installed in the duct 22 downstream of the heating unit 37 and monitors the moisture content of fluid which is about to enter the inlet 18. The detector 42 may be of the type known as HWK produced by the assignee of the present application. The detector 47 may constitute a conventional hygrometer.

The servomotor 27 is further connected with a potentiometer 51 whose output signal is indicative of the momentary positions of flaps 24, 26. Such signal is transmitted to an integrating circuit 52 which is further connected with a rated value selector 53 (e.g., an adjustable potentiometer) and with a gauge 54 serving to indicate the temperature of the drum 2. The gauge 54 may include a heat-sensitive semiconductor which is fixedly mounted on and rotates with the drum 2 and transmits voltage signals to a ring-shaped conductor on the periphery of the drum. Such conductor is engaged by a roller-shaped conductor which is connected to the corresponding input of the integrating circuit 52. The circuit 52 transmits signals to a signal comparing junction 56 which is further connected with a pressure gauge 64. The output signal from the junction 56 is amplified at 66 and is used to adjust a flow regulating valve 62 in a pipe **61*a* which connects a steam generator 61 with a manifold 61*b*. The latter admits steam into coils 63 which heat the drum 2 and preferably return condensate into the steam generator 61 by way of a passage in the pipe 61*a*. The latter may comprise two concentric cylindrical walls which define an inner passage for the flow of hot steam into the manifold 61*b* and an annular outer passage for the flow of condensate into the steam generator 61. The coils 63 rotate with the drum 2 and act not unlike blades or paddles which lift particles of tobacco from the lowermost portion of the conditioning zone in the drum 2 and thereupon allow the lifted tobacco particles to descend by gravity across the current of conditioning fluid which flows from the inlet 18 toward the outlet 19. Such agitation of tobacco particles in the conditioning zone contributes to the intensity of heat exchange between the fluid and tobacco. The gauge 64 is a transducer which furnishes to the junction 56 electric signals whose intensity is indicative of steam pressure in the conduit 61*a* and hence in the manifold 61*b* and coils 63**.

The operation:

The belt conveyor 11 delivers a continuous stream of moist tobacco particles 9, preferably at a constant rate which is insured by the provision of a weighing device upstream of the feeding means 11, 12. The stream of moist tobacco particles passes through the chute 12 and enters the left-hand end of the continuously rotating drum 2. The latter is preferably rotated at a constant speed, but such speed is adjustable by changing the ratio of the transmission 108. During travel through the conditioning zone within the rotating drum 2 (such travel is enhanced by slight downward inclination of the drum in a direction frcm the outlet 19 toward the inlet 18), the particles of tobacco are conditioned by the heated drum (particularly by the steam-heated coils 63 which rotate with the drum) as well as by the current of hot fluid which is admitted via inlet 18 and flows toward the outlet 19. The moisture content of tobacco decreases sufficiently before it reaches the right-hand end of the drum 2, and the thus conditioned tobacco 13 then passes through the chute 14 and trough 16 to descend onto the upper stretch of the take-off conveyor 17.

The moisture-laden fluid leaves the drum 2 by way of the outlet 19 and enters the portion **22*a* of the duct 22 to be divided into two smaller currents including a first current which is allowed to escape into the atmosphere via opening 28 and a second current which flows into the main portion of the duct 22 and is mixed with drier fresh fluid entering via opening 29. The mixture of recirculated moisture-laden fluid and freshly admitted fluid (i.e., the mixture of the aforementioned second current with a third current entering the duct 22 via opening 29) is heated by the element 37*b* and enters the drum 2 via inlet 18. The fan 23 serves as a means for expelling some moisture-laden fluid via opening 28, for drawing fresh fluid via opening 29, and for circulating the current of fluid along an endless path defined by the duct, inlet 18, conditioning zone in the drum 2, and outlet 19. The heated mixture of fresh fluid and recirculated moisture-laden fluid flows past the temperature detector 32 and moisture detector 47 on its way into the inlet 18. The detector 32 furnishes signals which are indicative of the temperature of successive increments of fluid flowing toward the inlet 18, and such signals are utilized for automatic regulation of fluid temperature by way of the junction 34, amplifier 36 and register 37*a*. The amplifer 36 adjusts the register 37*a* whenever the intensity of a signal which is supplied by the detector 32 deviates from intensity of the signal supplied by the potentiometer 33**.

Each of the flaps 24, 26 normally assures an intermediate or neutral position to thus allow for escape of a certain quantity of moisture-laden fluid via opening 28 and for admission of an equal or nearly equal quantity of drier fresh fluid via opening 29. For example, when the flaps 24, 26 assume such neutral positions, one-half of moisture-laden fluid escapes via opening 28 and one-half of moisture-laden fluid flows into the main portion of the duct 22 to be mixed with an equal quantity of fresh fluid.

If the moisture content of conditioned tobacco particles 13 deviates from a predetermined optimum moisture content (indicated by the signal from the potentiometer 44), the intensity of signal supplied to the junction 43 by the detector 42 deviates from the intensity of signal which the junction 43 receives from the potentiometer 44. The junction 43 then transmits a signal to the junction 46. Such signal is transmitted to the amplifier 48 for the servomotor 27. If the moisture content of conditioned tobacco particles 13 is too high, the servomotor 27 is caused to pivot the flap 24 clockwise, as viewed in the drawing, and to simultaneously pivot the flap 26 counterclockwise. Consequently, the opening 28 discharges a higher percentage of moisture-laden fluid and the opening 29 admits fresh fluid at a higher rate. Such fresh fluid can be preheated during passage along the auxiliary heating unit 137. The adjustment of flaps 24, 26 takes place with a minimum of delay and continues until such time when the signal from the detector 47 in the pipe 22 matches the signal from the junction 43. In other words, the signal which is transmitted from the junction 43 to the junction 46 of the regulating unit 41 is the controlling signal, and the adjustment of servomotor 27 is terminated when the intensity of such controlling signal is matched by the intensity of signal which is furnished by the detector 47. The practically instantaneous adjustment of flaps 24, 26 in response to a signal from the amplifier 48 insures that the moisture content of conditioned tobacco particles 13 is changed to the desired value with a minimum of delay, i.e., that only a very short portion of the tobacco stream on the conveyor 17 consists of tobacco particles whose moisture content does not match a predetermined or desired moisture content selected by the setting of potentiometer 44.

It is desirable to return the flaps 24, 26 to their intermediate or neutral positions shortly or immediately after the moisture content of tobacco particles 13 in the trough 16 again equals the desired moisture content. This will be readily understood since the heating unit 37 will consume much more energy if the opening 28 is allowed to discharge a relatively high percentage of hot moisture-laden fluid into the atmosphere. Moreover, when the flaps 24, 26 dwell in their neutral positions, the regulating unit 41 is capable of changing the moisture content of tobacco at the highest rate of speed. In fact, the flaps 24, 26 should be allowed to reassume their neutral positions even if the moisture content of conditioned tobacco particles 13 continues to deviate from the desired moisture content, i.e., the more pronounced conditioning action should be taken over by the means for heating the drum 2. This is achieved as follows When the flaps 24, 26 leave their neutral positions, the potentiometer 51 transmits a signal to the integrating circuit 52, and such signal is totalized with the signal supplied by potentiometer 53. The thus intensified signal from the circuit 52 is transmitted to the junction 56 which causes the valve 62 to admit more steam into the manifold 61*b* and coils 63. The pressure of steam in the coils 63 increases and the temperature of the drum 2 rises. The raising of the drum temperature takes up a certain interval of time (the length of such interval is dependent on thermal inertia of the drum 2 and coils 63); however, when such time interval elapses, the heating action of the drum 2 and coils 63 upon the tobacco stream in the conditioning zone increases. This is detected at 54 and the circuit 52 ceases to transmit an intensified signal to the junction 56. Also, the moisture content of conditioned tobacco particles 13 ceases to deviate from an optimum moisture content so that the servomotor 27 is caused to return the flaps 24, 26 to their neutral positions. This is detected by the potentiometer 51 which signals the new positions of flaps 24, 26 to the circuit 52. The signal from the temperature detector 54 to the circuit 52 insures that the latter continues to transmit an intensified signal to the junction 56 so that the steam pressure in the coils 63 remains higher and the heated drum 2 continues to perform a greater share of the work which is needed to reduce the moisture content of tobacco particles 9 to a desired value. In other words, a signal from the detector 54 continues to cause the valve 62 to admit more steam into the coils 63 after the signal from the potentiometer 51 reassumes its normal intensity which indicates that the flaps 24, 26 have reassumed their neutral positions.

The regulating units 31, 41 and the means for regulating the pressure of steam in the coils 63 operate analogously when the detector 42 furnishes a signal which indicates that the measured moisture content of conditioned tobacco particles 13 in the trough 16 is too low. The flaps 24, 26 are then temporarily adjusted in directions to reduce the quantity of moisture-laden fluid which escapes via opening 28 and to reduce the steam pressure in the coils 63. The flaps 24, 26 reassumes their neutral positions as soon as the temperature of the drum 2 drops sufficiently to insure that the reduction of moisture content due to contact between tobacco particles and the drum 2 (and coils 63) is less pronounced than before.

It will be seen that, by changing the positions of flaps 24, 26 of the controlling means, one can rapidly change the moisture content of tobacco particles if the measured moisture content deviates from that moisture content which is selected by the setting of potentiometer 44. On the other hand, the circuit 52 can effect an adjustment of the means 61-63 for heating the conveyor 1 when the moisture content of tobacco particles 13 is too high or too low for a longer interval of time. The heating action of the conveyor is much more intensive than the heating action of fluid which flows from the inlet 18 toward the outlet 19; however, the temperature and/or moisture content of fluid in the drum 2 can be changed much more rapidly than the temperature of the drum. Also, whereas the effect of an adjustment of flaps 24, 26 on the moisture content of tobacco particles in the drum 2 is rather limited, a pronounced change in temperature of the drum 2 can effect a substantial change in the moisture content of tobacco particles in the conditioning zone. This explains the aforementioned feature of maintaining the flaps 24, 26 in their neutral positions in which the unit 21 is best suited to effect a rapid change in the moisture content of tobacco particles while at the same time insuring that a substantial percentage of moisture-laden fluid is recirculated into the inlet 18.

The heating of fluid in the duct 22 to a predetermined temperature and the admission of substantially constant quantities of fluid per unit of time (via inlet 18) contribute to predictability and reproducibility of the conditioning operation.

An important advantage of the improved apparatus is that a relatively high percentage of fluid can be recirculated into the conditioning zone so that the intensity of heating action by the element 37*b* and the unit 137 need not be as pronounced as if the entire moisture-laden fluid were discharged into the atmosphere. Since the fluid is used for effecting rapid changes in moisture content of conditioned tobacco particles (if such moisture content deviates from that indicated by the signal from the potentiometer 44), the extent to which the fluid is to be heated is important to insure practically instantaneous changes in moisture content in response to pivoting of the flaps 24, 26 from their neutral positions. The interval of time which elapses before the heating system for the drum 2 and coils 63 is effective to change the temperature of the parts 2, 63 is that interval during which the mixing unit 21 insures that the fluid conditions the tobacco particles to an extent which is necessary to guarantee that the final moisture content is satisfactory.

Without further analysis, the foregoing will so fully reveal the gist of the present invention that others can, by applying current knowledge, readily adapt it for various applications without omitting features which fairly constitute essential characteristics of the generic or specific aspects of our contribution to the art and, therefore, such adaptations should and are intended to be comprehended within the meaning and range of equivalence of the claims.

What is claimed is:

1. Apparatus for reducing the moisture content of a stream of tobacco particles, comprising a conveyor defining an elongated conditioning zone having first and second ends; means for feeding a stream of moist tobacco particles into said first end; means for receiving dried tobacco particles at said second end; means for heating said conveyor; means for circulating through said zone a current of heated gaseous fluid in a direction from said second toward said first end so that the particles of tobacco in said zone are heated by said conveyor and by said current and release moisture which is entrained by the fluid, including a duct communicating with said ends and having a first opening for evacuation of a portion of moisture-laden fluid leaving said zone and means for conveying the non-evacuated fluid into the second end of said zone, said duct having a second opening for admission of drier fluid which replaces the evacuated portion of moisture-laden fluid and is mixed with non-evacuated moisture-laden fluid prior to entering said zone by way of said second end whereby the quantity of fluid entering said second end of said zone is at least substantially constant; adjustable means for controlling the rate of flow of fluid through at least one of said openings; means for measuring the moisture content of dried tobacco particles; means for comparing the measured moisture content with a predetermined moisture content; and means for adjusting said controlling means as a function of deviations of measured moisture content from said predetermined moisture content.

2. Apparatus as defined in claim 1, wherein said controlling means includes first and second displaceable valve means for respectively regulating the effective sizes of said first and second openings and adjustable displacing means for said valve means.

3. Apparatus as defined in claim 2, wherein said displacing means comprises a motor arranged to adjust said valve means substantially simultaneously so that the quantity of moisture-laden fluid which is evacuated via said first mentioned opening equals or approximates the quantity of drier fluid which enters said duct by way of said second opening.

4. An apparatus as defined in claim 2, further comprising means for maintaining the temperature of fluid which enters said zone via said second end within a predetermined range.

5. Apparatus as defined in claim 2, further comprising means for heating the drier fluid prior to admission into said duct by way of said second opening.

6. Apparatus as defined in claim 2, wherein said conveyor includes means for agitating the particles of tobacco in said zone.

7. Apparatus as defined in claim 2, wherein said heating means comprises at least one heating coil in said zone, a source of steam, means for connecting said source with said coil, and valve means for regulating the rate of steam flow into said coil.

8. Apparatus as defined in claim 2, further comprising means for normally maintaining said controlling means in a predetermined neutral position corresponding to a predetermined rate of evacuation of moisture-laden fluid via said first opening and to a predetermined rate of admission of drier fluid via said second opening.

9. Apparatus as defined in claim 8, wherein said heating means is adjustable and further comprising means for adjusting said heating means in response to adjustment of said controlling means.

* * * * *